US006859146B2

(12) United States Patent
McGreal et al.

(10) Patent No.: US 6,859,146 B2
(45) Date of Patent: Feb. 22, 2005

(54) SMOKE ALARM AND MOUNTING KIT

(75) Inventors: Timothy R. McGreal, Orland Park, IL (US); Laura L. McGreal, Orland Park, IL (US); Marilyn L. McGreal, Palos Heights, IL (US)

(73) Assignee: SafetyWise LLC, Orland Park, IL (US)

( * ) Notice: Subject to any disclaimer, the term of this patent is extended or adjusted under 35 U.S.C. 154(b) by 74 days.

(21) Appl. No.: 10/411,952

(22) Filed: Apr. 11, 2003

(65) Prior Publication Data

US 2003/0227389 A1 Dec. 11, 2003

Related U.S. Application Data

(60) Provisional application No. 60/371,780, filed on Apr. 11, 2002.

(51) Int. Cl.[7] ..... G48B 23/00

(52) U.S. Cl. ..... 340/693.6; 340/693.11; 248/544; 16/110.1

(58) Field of Search ..... 340/693.6, 693.9, 340/693.11; 248/544, 343, 346.03–346.05, 349.1, 346.5; 16/110.1, 429; 294/132–136, 19.1, 24, 26.5, 27.1, 65.5, 81.1, 67.1, 902; 81/53.1

(56) References Cited

U.S. PATENT DOCUMENTS

| | | | | |
|---|---|---|---|---|
| 3,582,123 | A | 6/1971 | Kyser | 294/19 |
| D246,635 | S | 12/1977 | Boldt et al. | D10/106 |
| 4,074,341 | A | 2/1978 | Niederöst et al. | 361/331 |
| 4,702,452 | A | 10/1987 | Penar | 248/217 |
| 5,149,038 | A | 9/1992 | VanCleve | 248/297.2 |
| 5,153,567 | A | 10/1992 | Chimento | 340/691 |
| 5,186,653 | A | 2/1993 | Robert | 439/500 |
| 5,188,332 | A | 2/1993 | Callas | 248/844 |
| 5,563,766 | A | 10/1996 | Long et al. | 361/600 |
| 5,577,696 | A | 11/1996 | Kramer | 248/206.5 |
| 5,751,218 | A | 5/1998 | Winterble et al. | 340/693 |
| 6,057,775 | A | 5/2000 | Sakurai et al. | 340/629 |
| 6,065,787 | A | 5/2000 | Jarosch | 294/19.1 |
| 6,181,251 | B1 | 1/2001 | Kelly | 340/628 |
| 6,208,257 | B1 | 3/2001 | Choi | 340/635 |
| 6,546,596 | B2 | 4/2003 | Grote et al. | 16/429 |
| 6,553,872 | B1 | 4/2003 | Tse et al. | 81/53.11 |
| 6,591,716 | B2 * | 7/2003 | Wantz | 81/53.1 |
| 6,644,617 | B2 * | 11/2003 | Pitlor | 248/544 |
| 2002/0066845 | A1 | 6/2002 | Pitlor | 248/544 |
| 2002/0079412 | A1 | 6/2002 | Pitlor | 248/206.5 |
| 2002/0170142 | A1 | 11/2002 | Kelly | 16/110.1 |

OTHER PUBLICATIONS

International Search Report dated Sep. 29, 2003.

* cited by examiner

*Primary Examiner*—Jeffery Hofsass
*Assistant Examiner*—Jennifer Stone
(74) *Attorney, Agent, or Firm*—Wood, Phillips, Katz, Clark & Mortimer

(57) ABSTRACT

A mounting kit and smoke detecting apparatus releasably mountable to a distant support surface, including a smoke detector weighing W, a support plate securable to the support surface and releasably securable to the smoke detector by a separating force of Y, and a longitudinal member having a proximate end graspable by a user and a distal end releasably securable to the smoke detector. A selectable first connector on the distal end is releasably securable to the smoke detector for mounting the smoke detector to the support plate and a selectable second connector is securable to the smoke detector for detaching the smoke detector from the support plate. The first connector is secured to the smoke detector by a separating force no greater than X and the second connector is secured to the smoke detector by a separating force no less than Z. At least one of X<(Y−W) and X<Y is true, and at least one of Y<Z and (Y−W)<Z is true.

34 Claims, 14 Drawing Sheets

SMOKE ALARM AND MOUNTING KIT

This application claims the benefit of U.S. Provisional Appl. No. 60/371,780, filed Apr. 11, 2002 by Laura Lynn McGreal and Timothy Richard McGreal entitled "Smoke Alarm Mounting/Installation/Removal From a Distance System and Method".

BACKGROUND OF THE INVENTION

The present invention is directed toward securing devices and more particularly toward mounting smoke alarms to support surfaces which are difficult to reach.

The use of various structures to secure devices at desired locations is, of course, well known in the prior art. Known prior art securing devices include, for example, U.S. Pat. No. 5,149,038; U.S. Pat. No. 4,702,452; U.S. Pat. No. 5,186,653; U.S. Pat. No. 5,188,332; U.S. Pat. No. 5,153,567; U.S. Pat. No. 5,563,766, U.S. Pat. No. 5,577,696 and U.S. Pat. No. Design 246,635.

While these devices fulfill their respective objectives and requirements, the aforementioned patents have limited utility in allowing for smoke alarms to be mounted to support surfaces which are difficult to reach, particularly where the smoke alarms must be accessed from time to time for servicing, as to replace a battery, or for regular cleaning per all smoke detector manufacturer instructions, or to replace defective units, or upgrade an entire system by replacing all units. It should also be noted that for all embodiments of the present invention, the system can be installed without the use of a ladder, with the exception of hard-wired systems which require an electrical connection to the mounting plate.

The present invention is directed toward overcoming one or more of the problems set forth above.

SUMMARY OF THE INVENTION

In one aspect of the present invention, a smoke detecting apparatus which is releasably securable to a support surface from a distance is provided, including a smoke detector, a support plate securable to the support surface, a longitudinal member having a proximate end graspable by a user and a distal end releasably securable to the smoke detector, a first releasable connection requiring a force of R on the smoke detector to connect the support plate and the smoke detector, and a second releasable connection between the smoke detector and the longitudinal member distal end.

In one form of this aspect of the invention, the support plate and the smoke detector are connectable at different relative angular orientations about a center, with a first electrical contact provided on one of the support plate and smoke detector and a second electrical contact provided on the other of the support plate and smoke detector. The first electrical contact is annular with a selected radius about the center and the second electrical contact is spaced the selected radius from the center whereby the first and second electrical contacts are in contact in all of the different relative angular orientations.

In another form of this aspect of the present invention, the first and second releasable connections are threaded engagements and the second releasable connection is releasable by a force of S, where R and S are torques and S>R. In one form of this aspect of the invention, the second releasable connection includes a snap releasable with a relative torque of S between the smoke detector and the longitudinal member distal end. In another form, the first and second releasable connections include matching threaded connections whereby a torque applied to the longitudinal member by a user unscrews one of the connections and screws together the other of the connections. In this form, a snap connection may also be provided between the smoke detector and the longitudinal member distal end, where the snap connection requires a torque of S to disconnect and a torque of R screws together the first releasable connection until the smoke detector threaded connection is seated in the support plate threaded connection.

In other forms of this aspect of the present invention, the first and second releasable connections are releasable snap connectors. The second releasable connection may include first and second selectable connectors on the longitudinal member distal end, where the first and second selectable connectors are releasably connectable to the smoke detector. In another form, the first connection has a separating force of Y, the first selectable connector is secured to the smoke detector by a separating force no greater than X, the second selectable connector is secured to the smoke detector by a separating force no less than Z, at least one of $X<(Y-W)$ and $X<Y$ is true, and at least one of $Y<Z$ and $(Y-W)<Z$ is true, where W is the weight of the smoke detector. $X<(Y-W)<Z$ when the support surface is a ceiling, and $X<Y<Z$ when the support surface is a wall. In a further form, the first and second connectors may be slotted balls receivable in a socket in the smoke detector, with the first connector slotted ball having wider slots than the second connector slotted ball, and the selected one of the first and second connectors, the smoke detector socket, and the detector plate are aligned along the axis.

In still another form of this aspect of the present invention, the support plate includes a first magnet releasably securable by a magnetic force greater than W to the smoke detector. In another form, the smoke detector includes a second magnet, the first and second magnets being circular. In still another form, the first releasable connection has a separating force of Y, the longitudinal member distal end includes a third magnet magnetically attracted to the smoke detector, a selectable spacing member is adapted to space the third magnet from the smoke detector by a distance A, wherein the magnetic attraction between the second magnet and the smoke detector is Z when adjacent and X when spaced apart a distance A, and at least one of $X<(Y-W)$ and $X<Y$ is true and at least one of $Y<Z$ and $(Y-W)<Z$ is true, where W is the weight of the smoke detector.

In another aspect of the present invention, a smoke detecting apparatus releasably securable to a support surface from a distance is provided, including a smoke detector weighing W with a detector plate, a support plate securable to the support surface and releasably securable to the detector plate where the support plate and detector plate release from one another with a separating force of Y, and a longitudinal member having a proximate end graspable by a user and a distal end releasably securable to the smoke detector. The distal end includes a selectable first connector releasably securable to the smoke detector for mounting the smoke detector to the support plate and a selectable second connector securable to the smoke detector for detaching the smoke detector from the support plate. The first connector is secured to the smoke detector by a separating force no greater than X and the second connector is secured to the smoke detector by a separating force no less than Z, where $Y>W$, at least one of $X<(Y-W)$ and $X<Y$ is true, and at least one of $Y<Z$ and $(Y-W)<Z$ is true.

In one form of this aspect of the invention, the support plate and the detector plate are releasably securable at different relative angular orientations about a center, with a first electrical contact provided on one of the support plate and detector plate and a second electrical contact provided on the other of the support plate and detector plate. The first electrical contact is annular with a selected radius about the center and the second electrical contact is spaced the selected radius from the center whereby the first and second electrical contacts are in contact in all of the different relative angular orientations.

In another form of this aspect of the invention, the releasable securing of the support plate and the detector plate comprises a releasable snap connector, and/or the first and second connectors comprise snap connectors. In further forms, the first and second connectors comprise slotted balls or two balls of differing diameters receivable in a socket in the smoke detector, the first connector slotted ball having wider slots than the second connector slotted ball.

In a further form, the selected one of the first and second connectors, the smoke detector socket, and the detector plate are aligned along the longitudinal member axis.

In still another form of this aspect of the invention, the support plate includes a first magnet releasably securable to the detector plate, wherein the detector plate and first magnet are securable together by a magnetic attraction force greater than W. In a further form, the detector plate is a magnet and both the first magnet and the detector plate are circular.

In yet another form of this aspect of the invention, the longitudinal member distal end includes a second magnet magnetically attracted to the smoke detector, and a selectable spacing member is adapted to space the second magnet from the smoke detector by a distance A, wherein the magnetic attraction between the second magnet and the smoke detector is Z when adjacent and X when spaced apart a distance A.

In another form, the support plate has a concave conical mating surface, and the detector plate has a convex conical mating surface.

In still another aspect of the present invention, a kit for releasably securing a smoke detector to a support surface from a distance is provided, including a support plate securable to the support surface, a longitudinal member having a proximate end graspable by a user and a distal end releasably securable to the smoke detector, and first and second releasable connecting members. The first releasable connecting member is adapted to connect the support plate and the smoke detector, with the first connecting member securing a connected support plate and smoke detector against disconnecting when subjected to a separating force up to Y. The second releasable connecting member is adapted to connect the smoke detector and the longitudinal member distal end, and includes selectable first and second connectors. The first connector is secured to the smoke detector by a separating force no greater than X and the second connector is secured to the smoke detector by a separating force no less than Z, where at least one of $X<(Y-W)$ and $X<Y$ is true, where W is the weight of the smoke detector, and at least one of $Y<Z$ and $(Y-W)<Z$ is true.

In one form of this aspect of the invention, the second releasable connection includes first and second selectable connectors on the longitudinal member distal end, where the first and second selectable connectors releasably connectable to the smoke detector. In a further form, the first releasable connection and the second releasable connection comprise snap connectors. In a still further form, the first and second connectors comprise slotted balls receivable in a socket in the smoke detector, with the first connector slotted ball having wider slots than the second connector slotted ball.

In another form of this aspect of the invention, the smoke detector weighs W, the first releasable connection has a separating force of Y, and the second releasable connection includes a magnet on the longitudinal member distal end which is magnetically attracted to the smoke detector and a selectable spacing member adapted to space the magnet from the smoke detector by a distance A, where the magnetic attraction between the second magnet and the smoke detector is Z when adjacent and X when spaced apart a distance A, where $X<(Y-W)<Z$.

In yet another aspect of the present invention, a kit for releasably securing a smoke detector to a support surface from a distance is provided, including a support plate securable to the support surface, a longitudinal member having a proximate end graspable by a user and a distal end releasably securable to the smoke detector, a first releasable connection requiring a force of R on the smoke detector to connect the support plate and the smoke detector, and a second releasable connection between the smoke detector and the longitudinal member distal end. The first releasable connection and the second releasable connection are threaded engagements and the second releasable connection is releasable by a force of S, where R and S are torques and $S>R$.

In one form of this aspect of the invention, the second releasable connection includes a snap releasable with a relative torque of S between the smoke detector and the longitudinal member distal end.

In another form of this aspect of the invention, the first releasable connection and the second releasable connection comprise matching threaded connections whereby a torque applied to the longitudinal member by a user unscrews one of the first releasable connection and the second releasable connection and screws together the other of the first releasable connection and the second releasable connection. In a further form, a snap connection is provided between the smoke detector and the longitudinal member distal end, where the snap connection requires a torque of S to disconnect and a torque of R screws together the first releasable connection until the smoke detector threaded connection is seated in the support plate threaded connection.

DETAILED DESCRIPTION OF THE INVENTION

In accordance with the present invention, a smoke detector can be selectively decoupled from a remote support surface to permit an individual to service or silence the smoke detector from a distance or for regular cleaning per all smoke detector manufacturer instructions, or to replace defective units, or upgrade an entire system by replacing all units. It should also be noted that for all embodiments of the present invention, the system can be installed without the use of a ladder, with the exception of hard-wired systems which require an electrical connection to the mounting plate.

Figure 1:
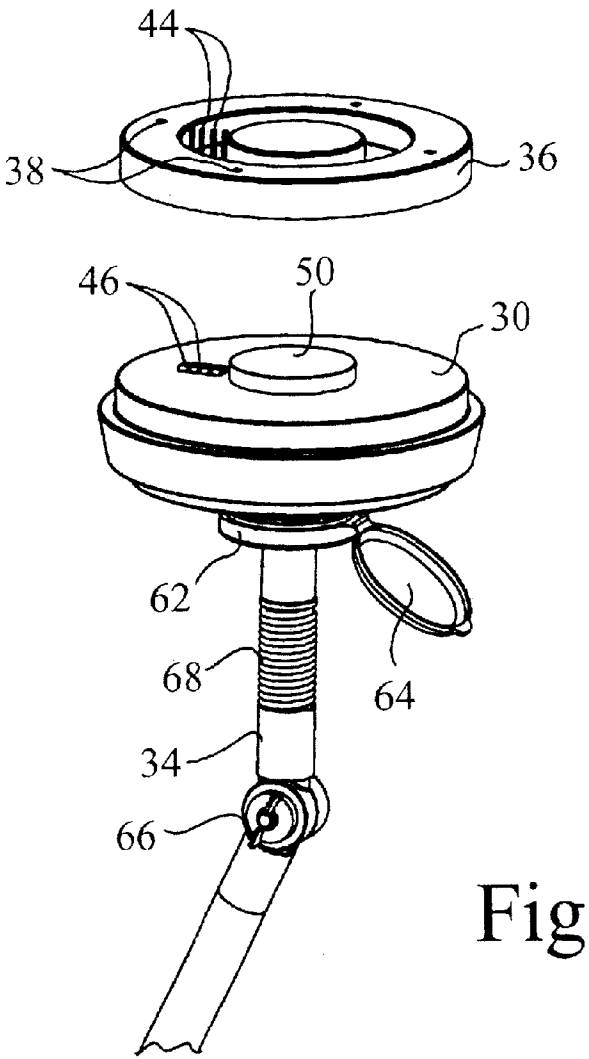
FIG. 1 is a perspective view of a first embodiment of the present invention.
Figure 2:
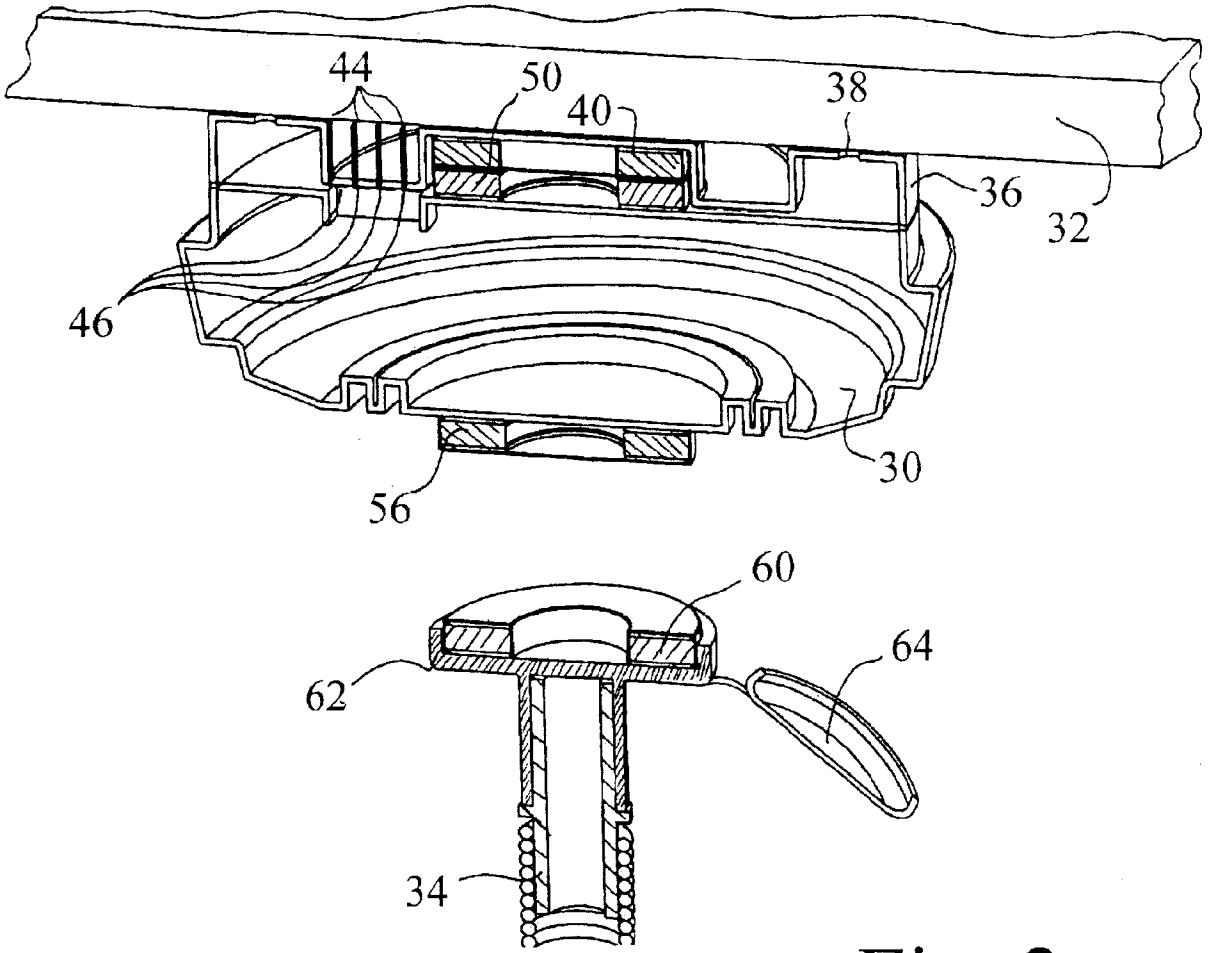
FIG. 2 is a perspective, cross-sectional view illustrating the imminent removal of a smoke detector from a supporting surface using the first embodiment of the present invention.
Figure 3:
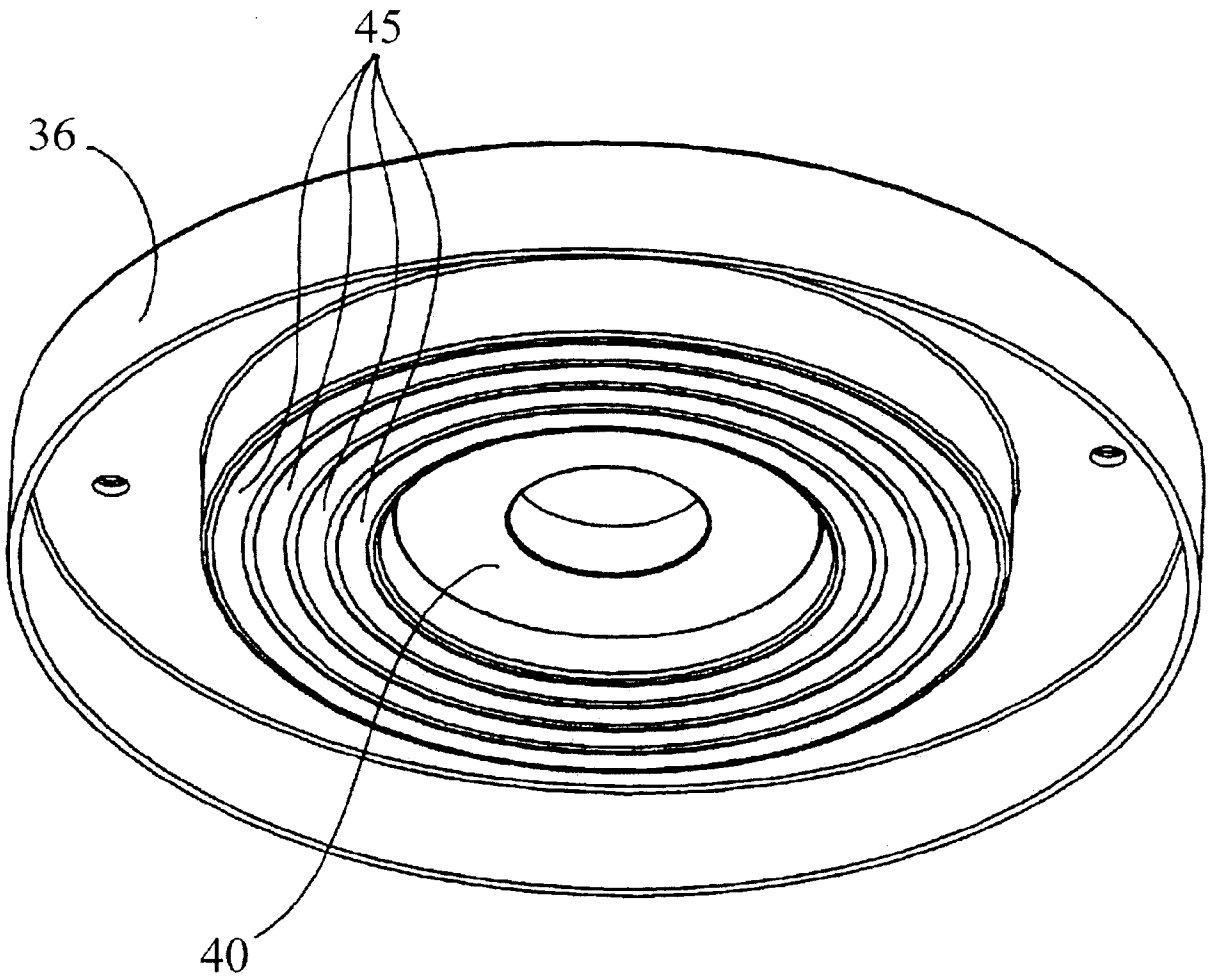
FIG. 3 is a perspective view of an alternate support plate usable with the first embodiment of the present invention.

One embodiment of the mounting structure for a smoke alarm or smoke detector 30 according to the present invention is shown in FIGS. 1–3. This embodiment uses magnetic couplings between the smoke detector 30 and the support surface 32, and between the smoke detector 30 and the longitudinal member 34, such as a pole, which may be used during installation and/or servicing to reach the smoke detector 30 mounted in a hard to reach location, such as a ceiling or high on a wall. For simplicity of illustration, only the smoke detector housing is illustrated in the figures, with the internal operating components thereof omitted.

In accordance with this embodiment, a support plate 36 may be suitably secured to a desired location on a support surface 32, such as a ceiling or a wall. The support plate 36 may be secured to the support surface 32 by any suitable support means, including means such as adhesive or a self-drilling fastener which may allow installation without requiring that the installer us a ladder, step stool, or the like. To accommodate a suitable fastener such as a screw or a self-drilling fastener, one or more mounting apertures 38 may be provided in the plate 36.

A magnet 40 is suitably secured to the support plate 36, as by a mechanical fastener or an adhesive. Alternatively, the support plate magnet 40 may include a mounting aperture directed therethrough as shown in the drawings permitting selective securement of the magnet 40 directly to the support surface 32 if so desired. The support plate 36 may also include suitable contacts or terminals 44 which may be connected as desired (e.g., for hard wired power or remote communication of the smoke detector 30). The terminals 44 are connected to downwardly facing ring connectors 45 (see FIG. 3) which may be connected at any point around their lengths to smoke detector contacts 46 to provide a detachable electrical connection between the support plate 36 and the smoke detector 30 in any angular orientation between the two.

A mating top magnet 50 is also suitably attached to the smoke detector 30, as by adhesive or mechanical fasteners, which magnet 50 may be selectively coupled to the support plate magnet 40 as described hereafter. When positioned adjacent one another, the magnets 40, 50 provide an attractive force therebetween whereby they may only be separated by a separating force of Y. It should be appreciated, therefore, that so long as Y is greater than the weight (W) of the smoke detector 30, the smoke detector 30 may be detachably or releasably secured via the support plate 36 to the support surface 32 which is horizontal (such as a ceiling).

Further, it should be appreciated that the illustrated cylindrical geometry of the magnets 40, 50 will enable the smoke detector 30 to be reliably connected to the support plate 36 no matter the annular orientation relative to each other. Further, it should be recognized that by selecting magnets 40, 50 which have opposite poles which extend laterally relative to the smoke detector 30 (i.e., not vertically in a ceiling mounted smoke detector 30), the magnets 40, 50 may be used to bias the smoke detector 30 about its central axis to a specific rotational position. This may therefore assist in ensuring, for example, that contacts will be suitably self-aligned during mounting where such alignment is desired or necessary.

Another releasable magnetic connection is also provided between the opposite (bottom) side of the smoke detector 30 and a mounting pole 34.

Specifically, a lower smoke detector magnet 56 is suitably attached to the bottom of the smoke detector 30 (e.g., by adhesives or mechanical fasteners). A mating pole magnet 60 is suitably secured to the end of the pole 34 in a retainer 62 which has a gap cap 64 which may be selectively capped onto the retainer 62 whereby the magnet 60 may be used to provide two different releasable connectors to the smoke detector 30 as described below. In an alternate embodiment, the pole magnet 60 may be an electromagnet suitably powered, as by a battery mounted in the pole.

Specifically, when installing a smoke detector 30, the cap 64 may be snapped over the magnet 60 whereby the upper surface of the cap 64 is a selected distance (A) from the upper surface of the magnet 60. The smoke detector 30 may then be placed with its lower magnet 56 adjacent the cap 64, whereby the magnetic force therebetween having a separating force X will securely hold the smoke detector 30 on the end of the pole 34. As illustrated in FIG. 1, the pole 34 may be provided with an adjustable elbow 66 as well as a resilient member 68 to reduce the sensitivity of the system to planar misalignments and to facilitate handling of the pole 34 and attached smoke detector 30.

The installer may then use the pole 34 to position the smoke detector 30 adjacent the support plate 36 mounted to the support surface 32 as previously described, with the support plate magnet 40 and upper smoke detector magnet 50 adjacent each other whereby their attractive magnetic force will secure them together in the desired position as previously noted. It should be appreciated that the magnetic force securing the smoke detector 30 to the pole 34 is selectively less than the magnetic force securing the smoke detector to the supporting plate 36, so that when the installer pulls the pole 34 away from the smoke detector 30, the smoke detector 30 will remain secured to the support plate 36 due to its greater securing force. In the case of a conventional horizontal ceiling mount, this would require that $X<(Y-W)$, where the separating force (Y) of the support plate connection should be sufficient to overcome both the separating force (X) of the pole 34 when it is pulled down and the weight (W) of the smoke detector.

Alternatively, where the smoke detector is to be mounted to a horizontal wall, the magnets could be selected whereby X<Y, since the support plate magnetic connection need not also support the weight of the smoke detector 30. For example, the smoke detector 30 may be received within a cup portion of a support plate where there is a mechanical interference between the side of the cup portion and the smoke detector 30 which supports the smoke detector 30, with the magnetic attraction (X) required only to be enough to prevent the smoke detector 30 from tipping out of the cup portion. If the wall connection does not have such a mechanical interference supporting the smoke detector 30, then the friction forces between the vertical surfaces must be sufficient to support the smoke detector. Of course, the friction forces in such a case would be a function of the magnetic attraction force between the magnets 40, 50 and the coefficient of friction.

When it is later desired to remove the smoke detector 30 from the support surface 32, such as for servicing (e.g., replacing batteries), the cap 64 may be removed from the top of the retainer 62 (a suitable snap may be provided along the side of the pole 34 to hold the cap 64 clear of the retainer 62), whereby the service person may reach up with the pole 34 and position the magnet 60 adjacent the bottom smoke detector magnet 56, without the spacing (A) therebetween caused by the cap 64. It will be appreciated that the magnetic attraction force, and the force required to separate the magnets, is a function, inter alia, of the proximity of the magnets 56, 60. In accordance with this embodiment of the present invention, the separating force (Z) of the magnets 56, 60 when directly adjacent one another (i.e., without the spacing A provided by the cap 64) is sufficient to overcome the separating force between the magnets 40, 50 holding the smoke detector 30 to the support plate 36. Thus, in the case of a conventional horizontal ceiling mount, X<(Y−W)<Z, and in the case of a vertical wall mount, X<Y<Z. Of course, if other forces also secure the smoke detector 30 to the support plate 36 (e.g., friction between the electrical contacts 44, 46), those forces may also be taken into account.

It should be appreciated that the above illustrated embodiment advantageously uses pairs of magnets to provide the magnet connections. As previously mentioned, the polarity of the magnet pairs assists may be used to ensure a desired rotational orientation. Further, the polarity of the magnet pairs on opposite sides of the smoke detector 30 may be used to ensure that the smoke detector 30 is not accidentally installed upside down. That is, the magnets may be installed so that an attempted connection between the pole 34 and the top magnet 50 of the smoke detector 30 would impossibly attempt to connect magnets at their same north or south poles. The same may be used to prevent connection of the bottom of the smoke detector 30 to the support plate 36. It should also be appreciated, however, that it would still be well within the scope of the invention to provide a single magnet with each connection, with a suitable magnetically attracted (but not itself magnetic) component, such as a steel plate, secured to the other of the components to be secured together.

It should be appreciated that any suitable selectable spacer, permitting selected different spacing such as provided by the cap 64 in the above described embodiment, may also be used in accordance with the present invention.

Figure 4:
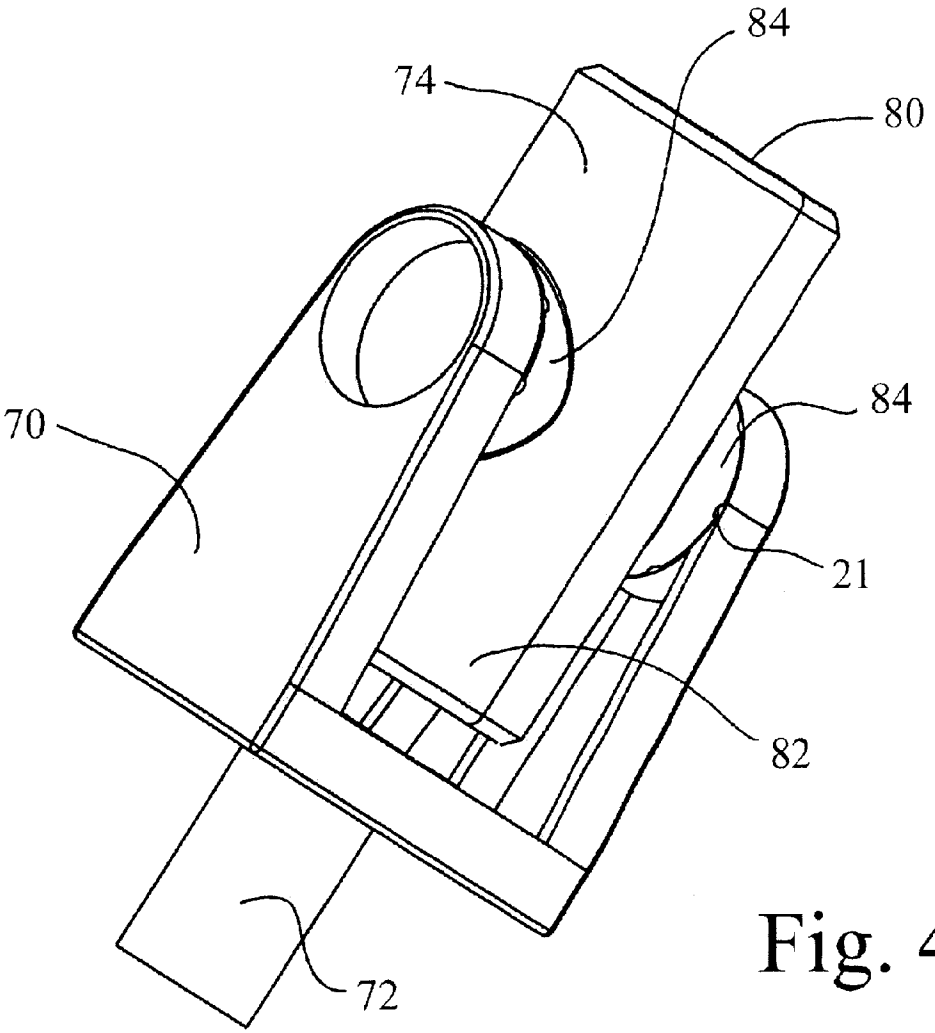
FIG. 4 is a perspective view of an alternate pole attachment structure usable with the first embodiment of the present invention.
Figure 5:
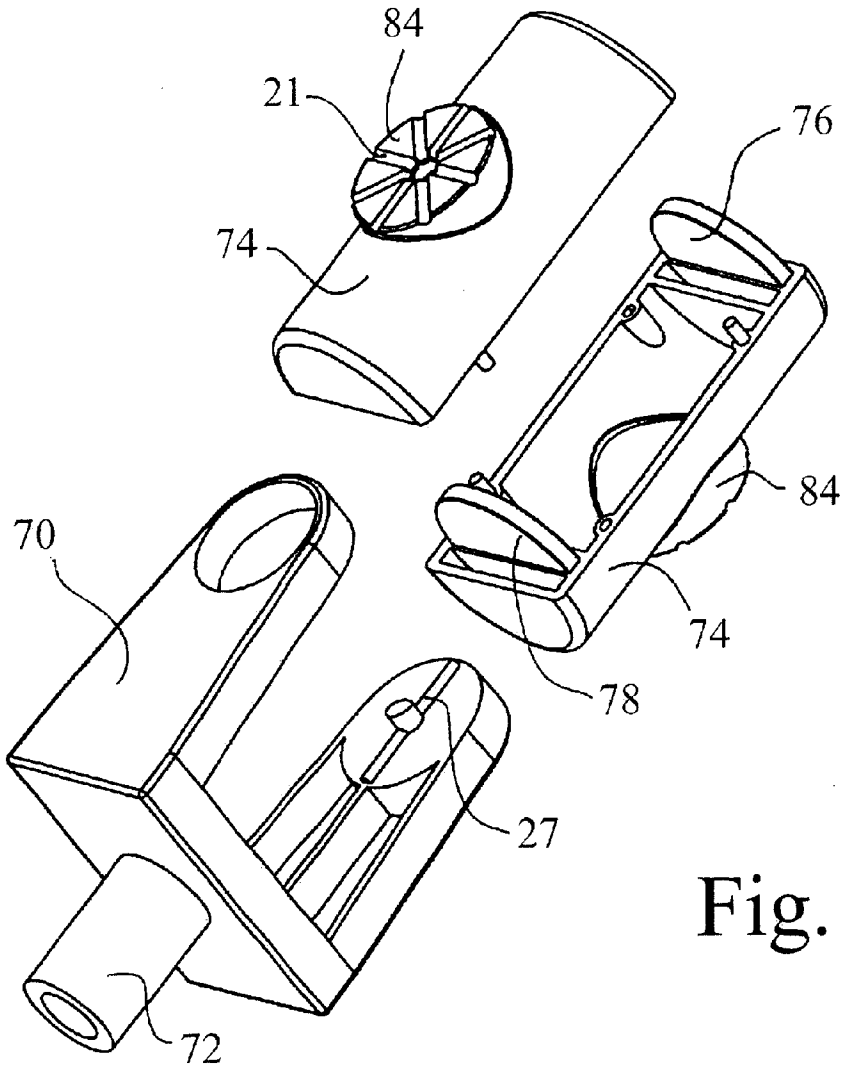
FIG. 5 is an exploded view of the FIG. 4 pole attachment structure.
Figure 6:
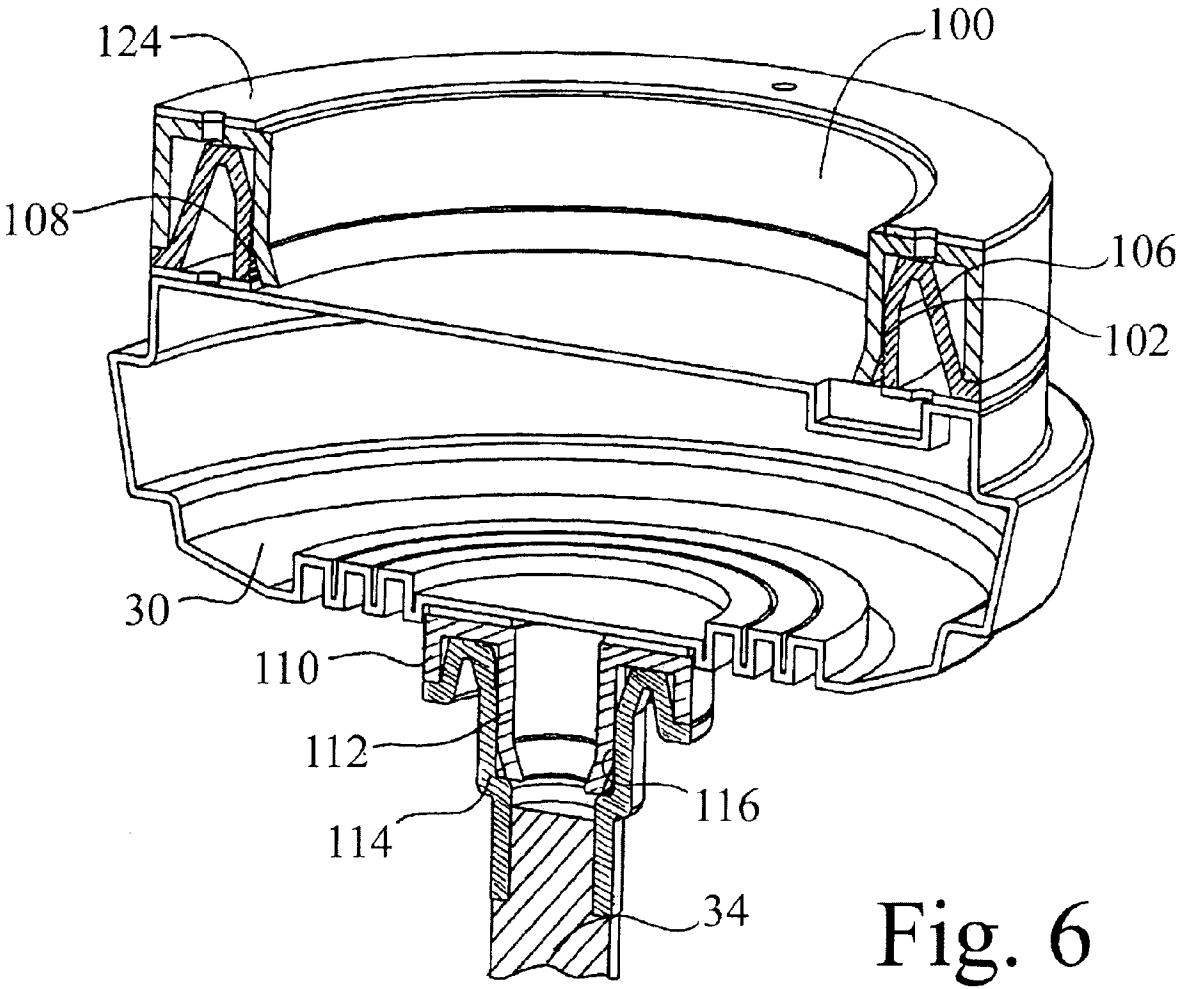
FIG. 6 is a perspective, cross-sectional view illustrating a second embodiment of the present invention.

For example, FIGS. 4 and 5 illustrate an alternative embodiment for a tool which may be secured to the end of the pole 34 to create two differing gaps, and hence two different magnetic forces using the same magnet type within the assembly. Specifically, a yoke 70 includes a suitable attachment portion 72 for securing to a selected pole 34. A housing 74 includes interior supports on opposite ends for supporting magnets 76, 78 at different spacings relative to the ends 80, 82 of the housing 74. Alternatively, to facilitate alignment, the magnets as described above may be designed of the "floating" type, similar to those that may commonly be found on kitchen cabinet doors.

Therefore, it will be appreciated that substantially identical magnets 76, 78 may be used at opposite ends 80, 82 of the housing 74 to provide different selectable connectors at each end having different magnetic attractive forces when the different housing ends are positioned adjacent the smoke detector lower magnet 56. Further, the housing 74 includes lateral cylindrical projections 84 which may be suitably connected to the yoke 70, as by a snap-fit between surfaces 21, 27, for pivoting between selected positions.

Detents 86 are provided yoke 70 and are receivable in selected slots in the housing cylindrical projections to allow the housing to be selectively secured in a position relative to the yoke 70 and pole 34, enabling the user to position the appropriate housing end 80, 84 (with selected separating force depending on the usage as previously described) in engagement with the smoke detector lower magnet 56 at a convenient position for reaching the support plate 36. For example, positioning the housing 74 at an angle (e.g., 45 degree angle) relative to the axis of the pole 34 can facilitate the installation of a smoke detector assembly on a non-horizontal, non-vertical surface such as a "cathedral" type ceiling. Of course, still other structures allowing positioning of different magnets/different magnetic forces relative to a selected smoke detector 30 may also be used within the scope of the present invention.

An alternative embodiment is shown in FIGS. 6–11 in which threaded connections are used instead of magnetic connections such as described above.

In accordance with this embodiment, a support screw plate 100 having right-handed external screw threads 102 may be suitable secured on its upper surface to a support surface (e.g., by adhesives or mechanical fasteners, such as previously described). An upper nut plate 106 is also suitably secured to the top of the smoke detector 30, such as by adhesives, fasteners, or the like. The support screw plate threads 102 can mate with the internal screw threads 108 of the upper nut plate 106.

A lower screw plate 110 with left-handed external screw threads 112 is suitably secured on the lower side of the smoke detector 30 (e.g., by adhesives, fasteners, or the like) and a lower nut plate 114 with left-handed internal screw threads 116 is suitably secured to the end of the pole 34. The screw threads 112, 114 of the lower screw plate 110 and the lower nut plate 114 are designed to mate with each other.

Figure 11:
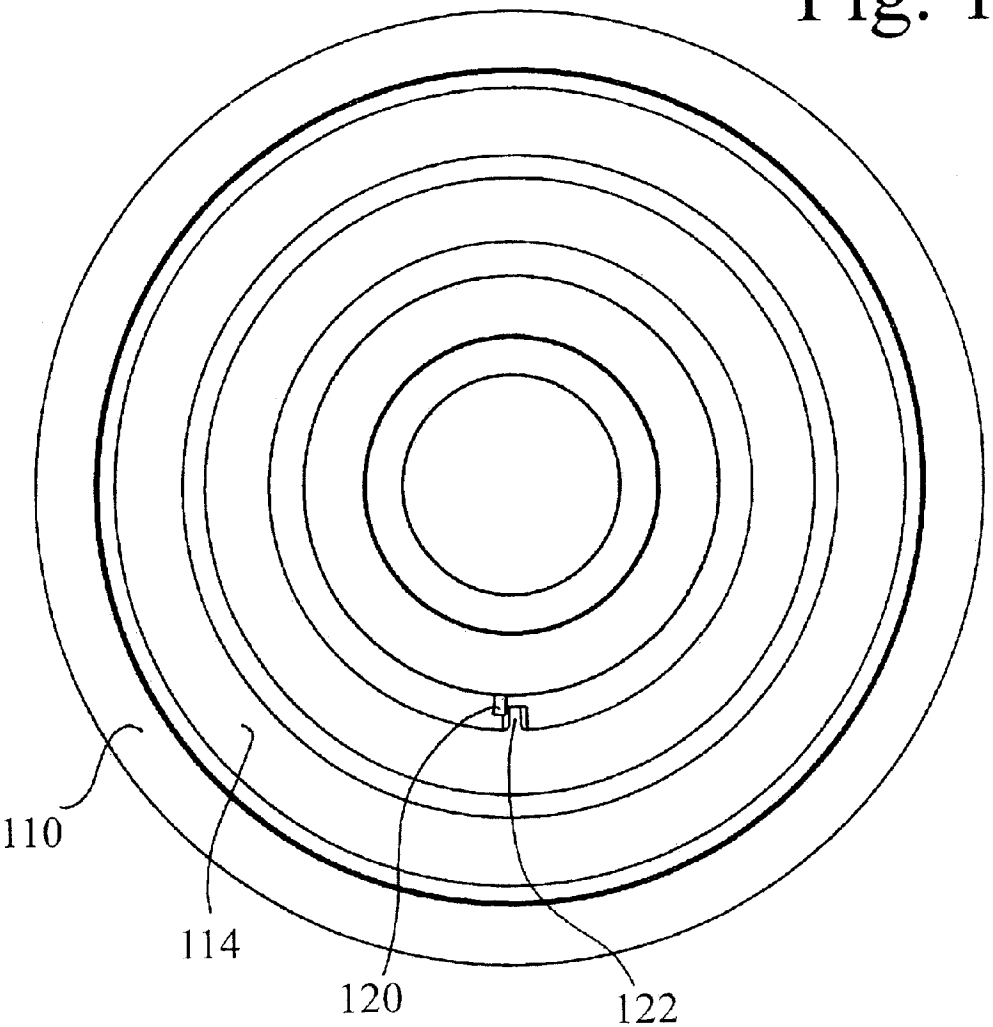
FIG. 11 is a cross-sectional view taken along line 11—11 of FIG. 10.

Cooperating snaps 120, 122 (see FIG. 8) are provided with the lower screw plate 110 and lower nut plate 114, respectively to provide a two-way snap fit between the lower nut plate 114 and the lower screw plate 112 when the two are sufficiently threaded together, as shown in cross-section in FIG. 11. A similar set of snaps is provided on the support screw plate 100 and the upper nut plate 106. The snaps may be chosen so that they may be "tuned" by a manufacturer to provide a connection having a fairly precise separating force, or may be more broadly selected with the separating force determined after manufacture by testing.

Figure 7:
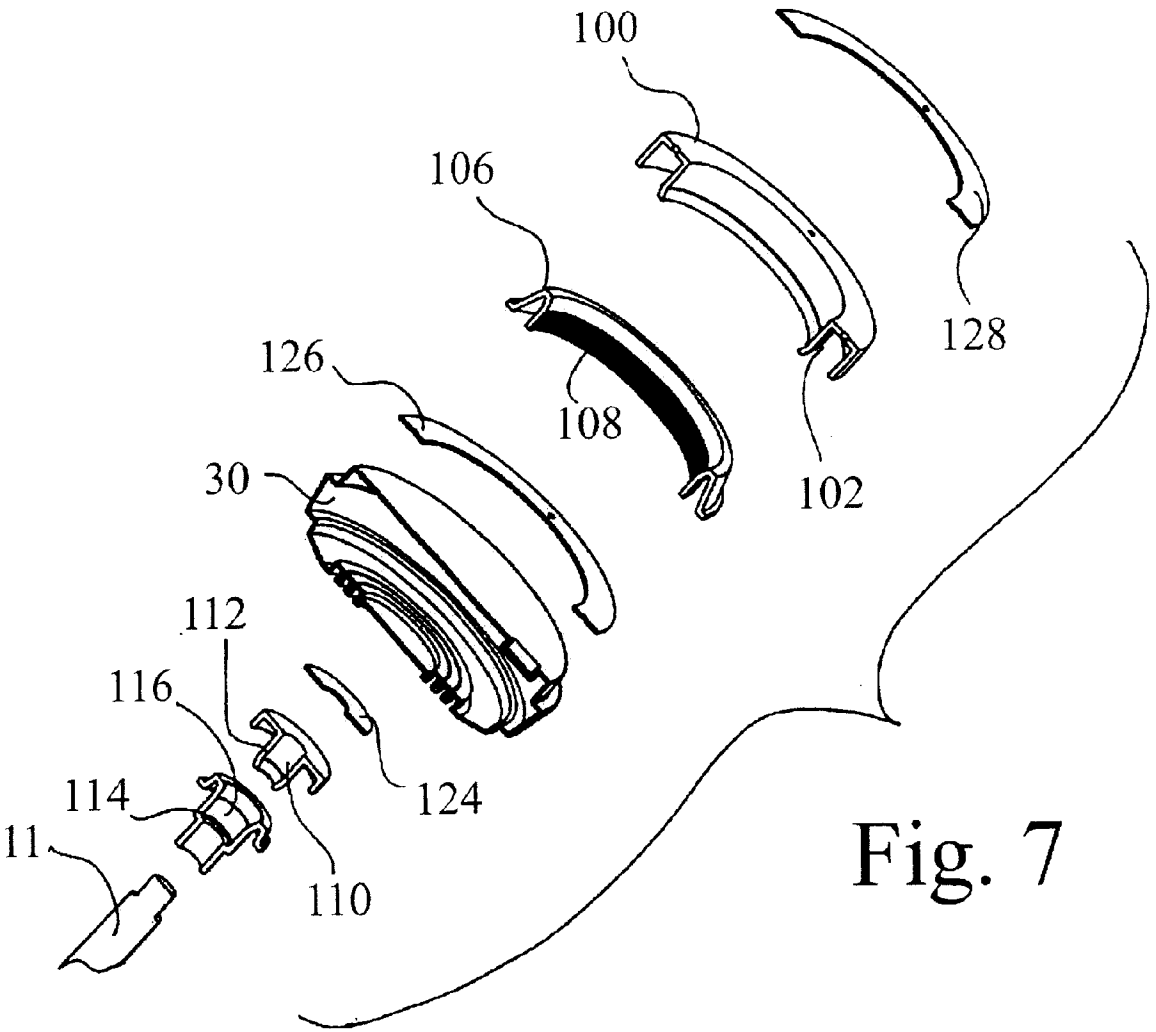
FIG. 7 is an exploded view of the second embodiment of the present invention.
Figure 8:
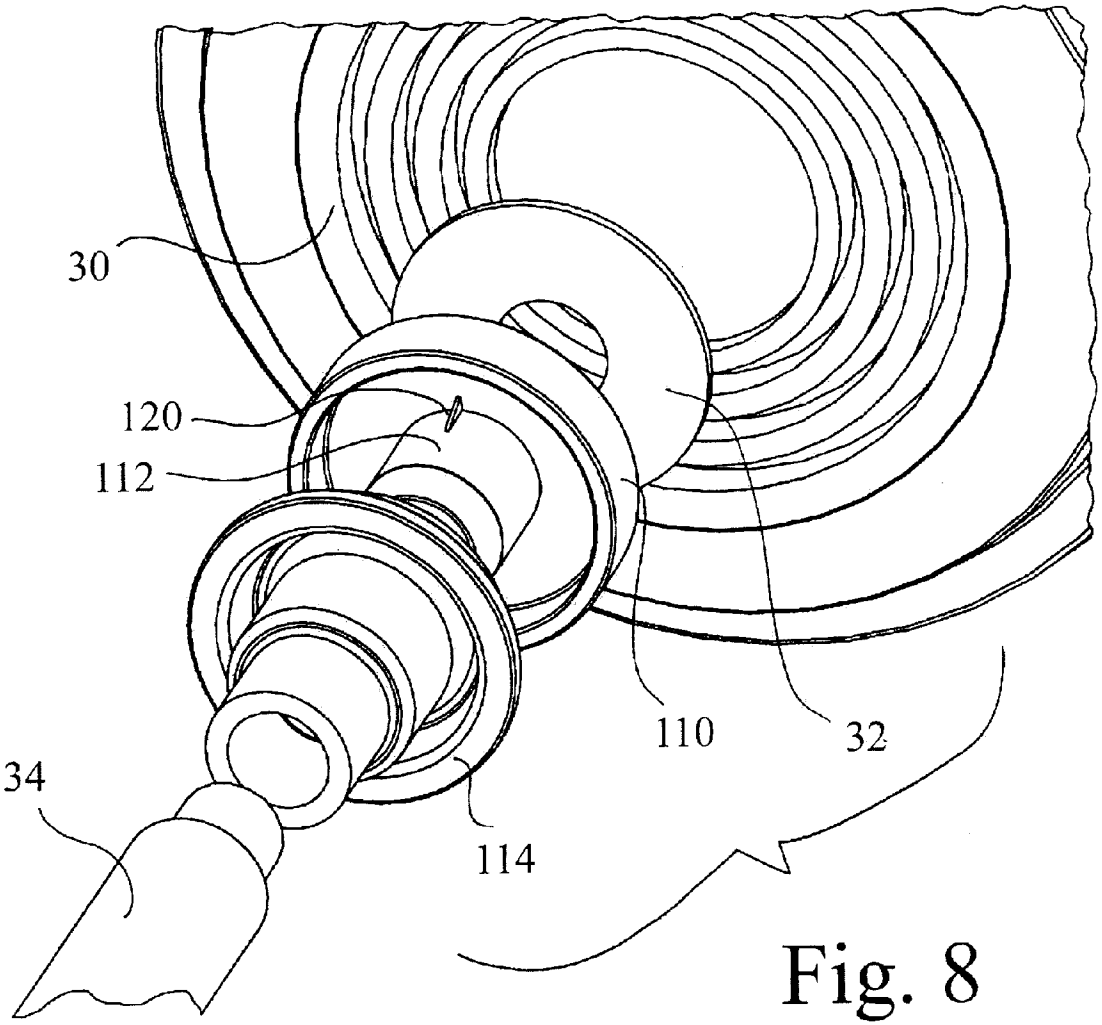
FIG. 8 is an enlarged, exploded partial view of the lower connection of a smoke detector and pole according to the second embodiment of the present invention.
Figure 9:
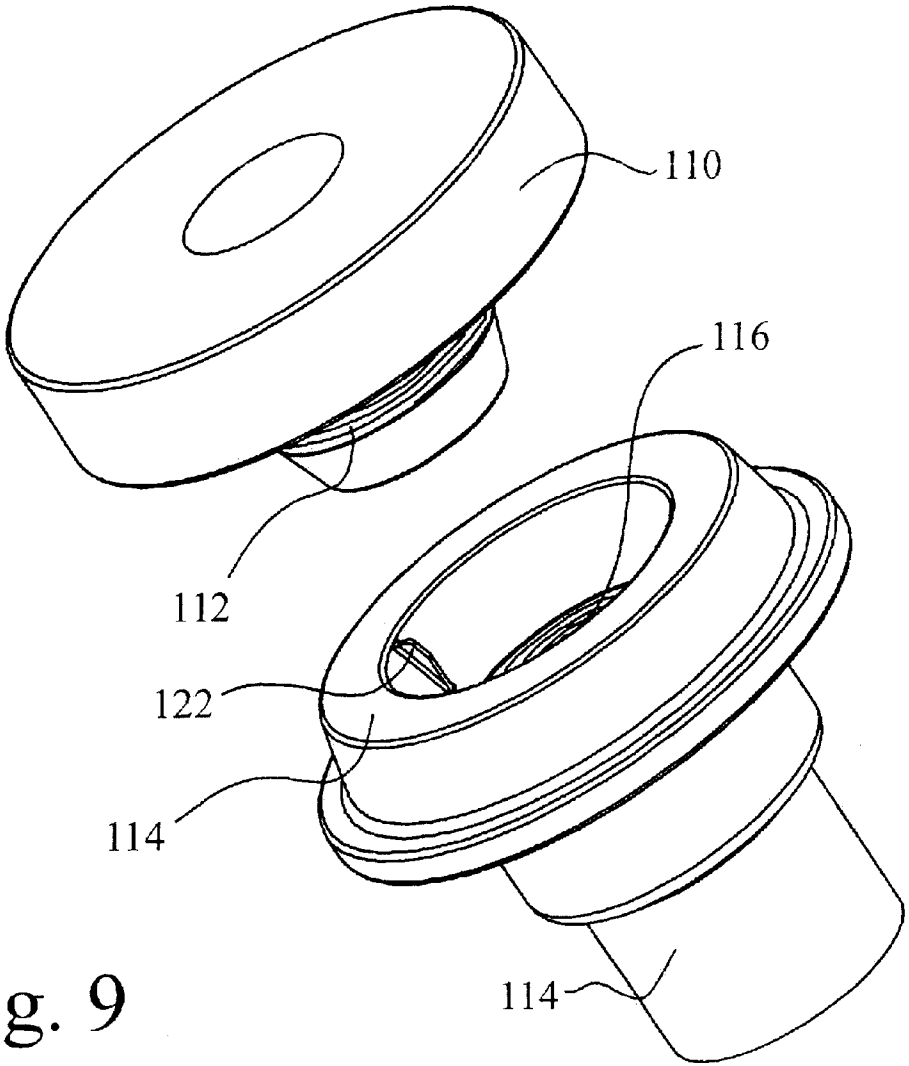
FIG. 9 is an exploded perspective view of the lower screw plate and lower nut plate of the second embodiment of the present invention.
Figure 10:
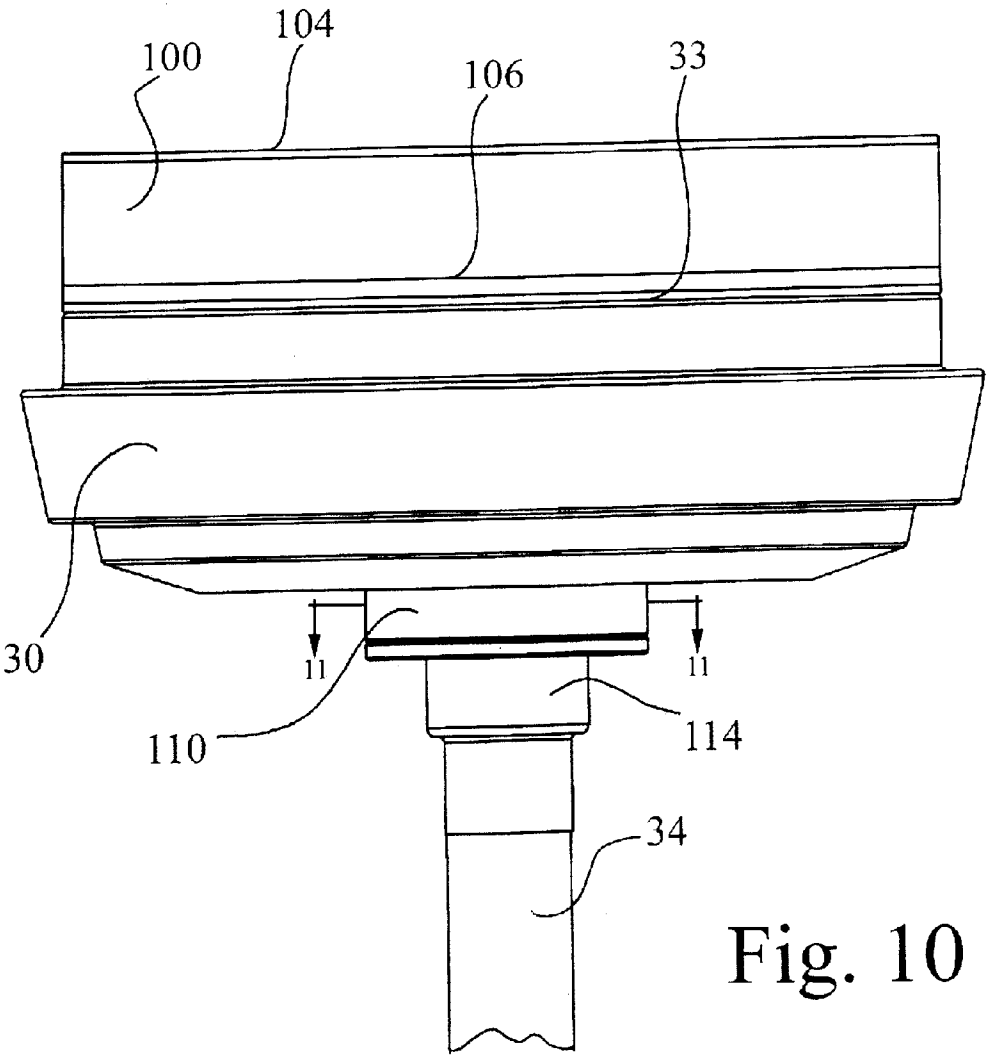
FIG. 10 is a side view of the second embodiment of the present invention.

As illustrated in FIG. 7, suitable mounting and spacing plates 124, 126, 128 may be used to facilitate use of the present invention with smoke detectors 30, including retrofitting with smoke detectors 30 not specifically adapted for connection of such mounting components. For example, the plates 124, 126, 128 may include mounting holes and/or adhesives on both sides for mounting between suitable smoke detectors 30 and mounting components. Moreover, it should be appreciated that the present invention encompasses not only smoke detectors inclusive with the mounting components (including pole 34), but also includes kits which may be provided separately from smoke detectors 30 where the kits may then be used with a selected smoke detector 30 for mounting at a desired location. It is conceivable that components of the present invention could also be used to install/remove other items from inaccessible locations, such as video (spy) cameras, banners, curtains, etc.

In accordance with this embodiment, an installer will first screw the lower screw plate 110 and lower nut plate 114 together until a pronounced "snap" of the cooperating snaps 120, 122 is heard, at which point the smoke detector 30 will be securely positioned on the pole 34. The installer then uses the pole 34 to raises the assembly up to position the upper nut plate 106 in the support screw plate 100 secured to the support surface 32, and then rotates the pole 34 clockwise (when looking up) until the upper nut plate 106 and support screw plate 100 "bottom out" and hence are rotatably locked together. At this point, the installer continues rotating the handle 34 clockwise (when looking up) and the left-handed threads of the lower screw plate 110 and lower nut plate 114 begin to unscrew. The process is complete when the lower screw plate 110 and lower nut plate 114 are completely disengaged, at which point the pole 11 is disconnected from the smoke detector 30 with the smoke detector 30 installed on the support surface 32.

Thereafter, when it is desirable to remove the smoke detector 30, the service person may raise the pole 34 up to mate the lower nut plate 114 (on top of the pole 34) with the lower screw plate 110 (on the bottom of the smoke detector 30), and then rotates the pole counter-clockwise until the lower screw plate 110 and lower nut plate 114 "bottom out" and hence are rotatably locked together. The counter-clockwise rotation is then continued until the support screw plate 100 and upper nut plate 106 are completely disengaged, at which point the smoke detector 30 will be disconnected from the support surface 32 and securely supported on the pole 34 whereby the service person may lower the pole 34 to gain access to the smoke detector 30.

The snaps can be utilized to prevent a user from not tightening the components properly enough by creating an audible indication when the screw threads have attained a specific level of engagement. Further, the snaps can operate to create an additional force holding the threaded components together which is greater than the releasing force (R) of the other threaded components so that, for example, when twisting the pole 34 when mounting the smoke detector 30 the threads between the lower nut plate 114 (on top of the pole 34) and the lower screw plate 110 (on the bottom of the smoke detector 30) will not begin to unthread until the threaded connection of the smoke detector 30 to the support surface 32 bottoms out.

Figure 12:
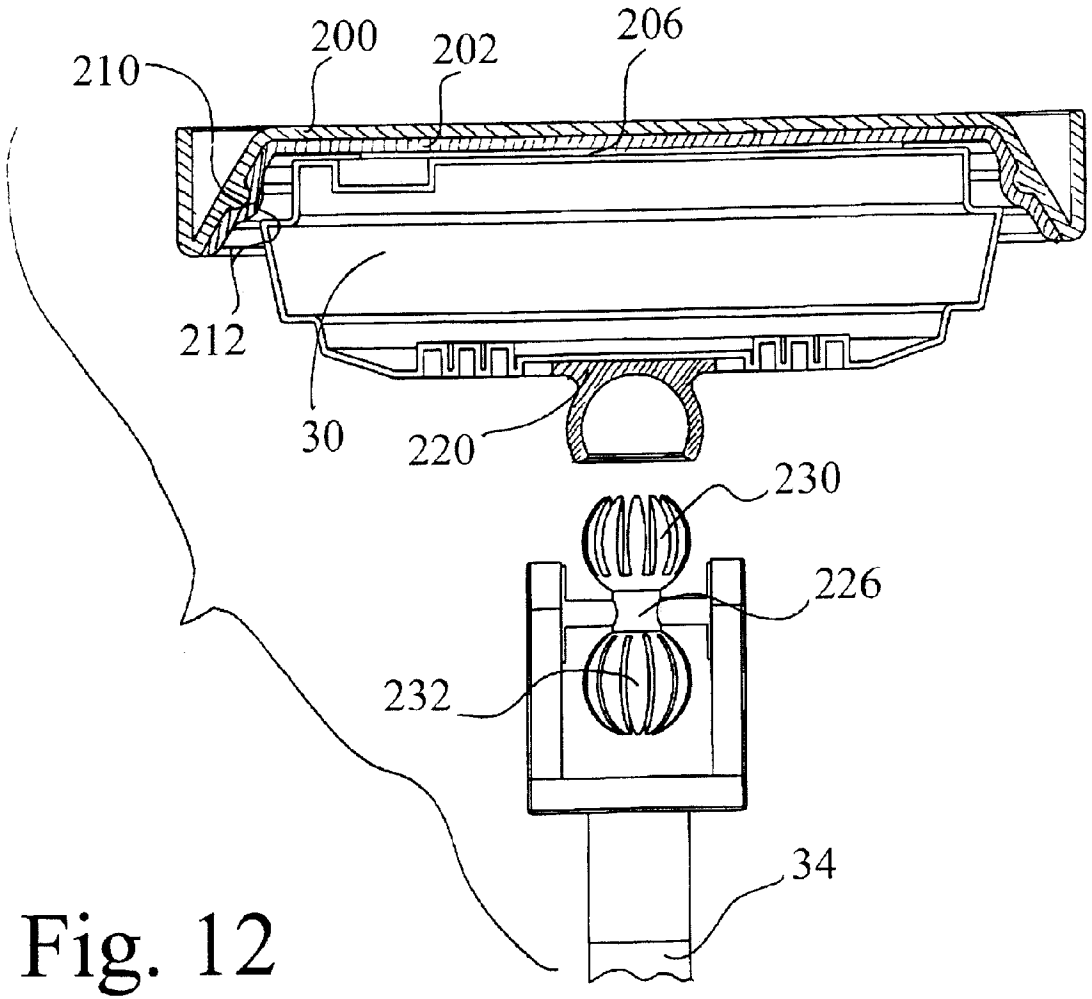
FIG. 12 is a side, partial cross-sectional view of a third embodiment of the present invention.
Figure 13:
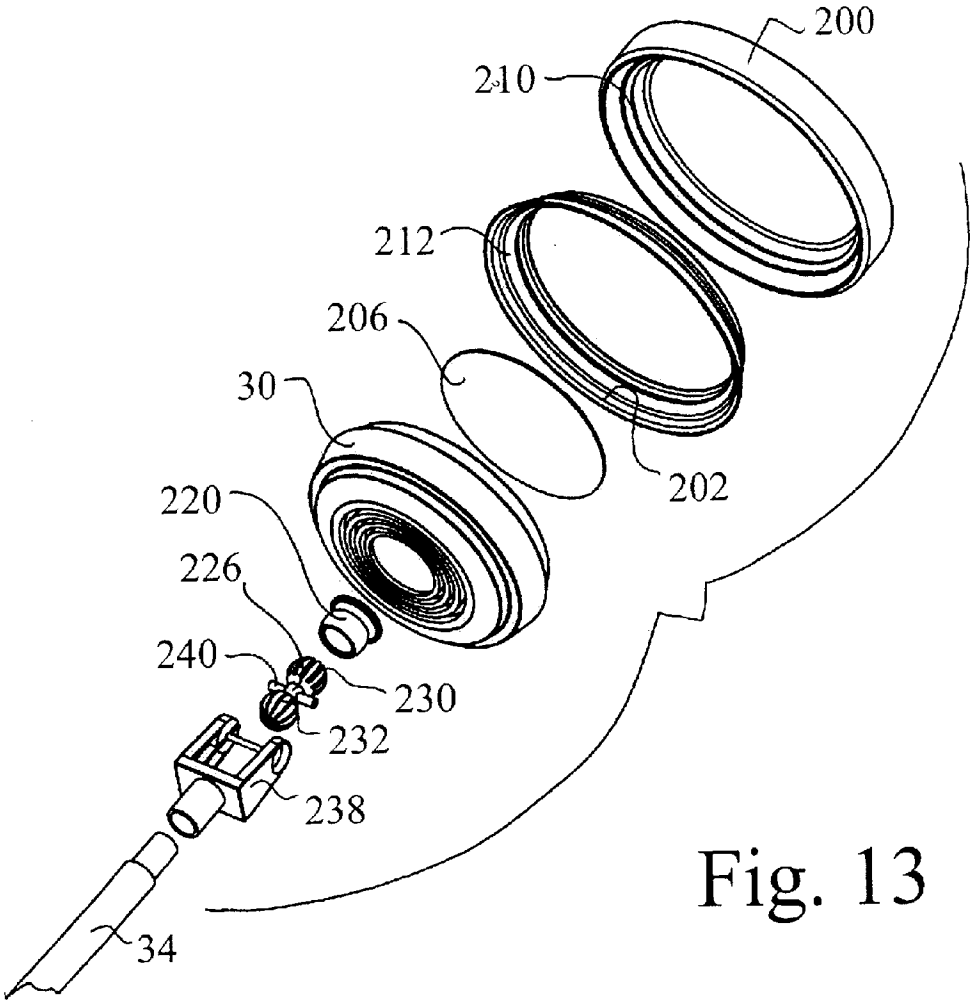
FIG. 13 is an exploded view of the third embodiment of the present invention.
Figure 14:
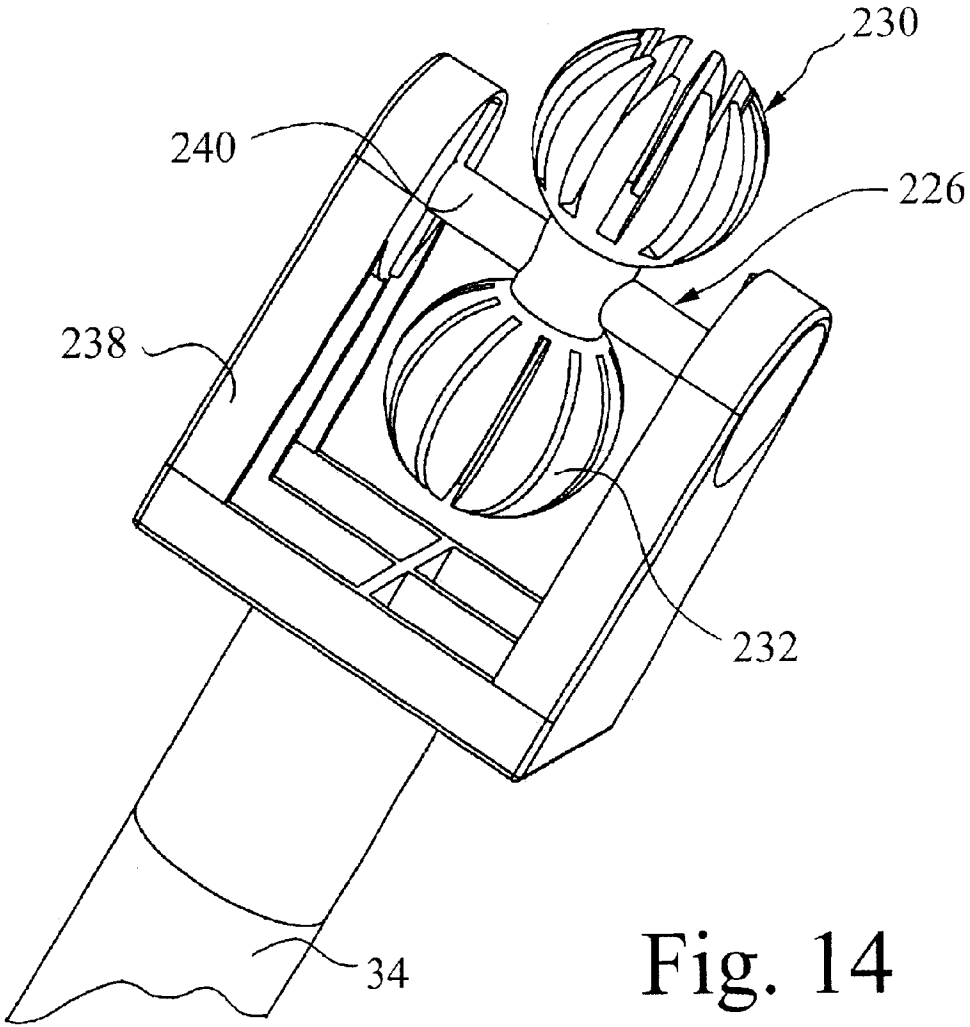
FIG. 14 is an enlarged perspective view of the pole attachment structure of the third embodiment of the present invention.

FIGS. 12–14 illustrate yet another embodiment incorporating the present invention using snap-type connections.

With this embodiment, a support snap plate 200 is suitably secured to a support surface 32 such as previously described, and a detector snap plate 202 is suitably secured to the top of the smoke detector 30, as by a mounting and spacing plate 206 which may, for example, have adhesive on both sides. The support snap plate 200 includes a detent-type annular projection 210 which may be snap-fit into an annular groove 212 in the detector snap plate 202. Similar to the magnetic-attraction embodiment, the snap connection has a separating force of Y. It should be appreciated that a snap connection may be used which may be separated by twisting, in which case the separating force would be required to be sufficient to allow twisting sufficient for such separation without separating the pole 34 from the smoke detector 30.

A socket-type receiver 220 is suitably secured to the lower side of the smoke detector 30, for mating with a selected one of two connectors secured to the pole 34. Specifically, a connecting member 226 includes two selectable connectors comprising a pair of slotted balls 230, 232, where one ball 230 is configured (e.g., by use of larger slots permitting the fingers forming the ball 230 to be more easily bent) so as to have a lower separation force (X) from the socket-type receiver 220 than the separation force (Z) of the other ball 232. The relationship of X, Y and Z such as previously stated with the magnetic-attraction embodiment may also be provided with this embodiment.

Further, similarly to the embodiment illustrated in FIGS. 4 and 5, the connecting member 226 is rotatably secured to a yoke 238 secured to the pole 34, with a suitable detent between the connecting member pivot 240 and the yoke 238 to secure the selected slotted ball 230, 232 in the desired position for use.

It should also be recognized that a magnetic coupling (including permanent magnets and electromagnets), screw-type fastener, hook-and loop, removable adhesive may be utilized instead of a snap-fit and vice versa. Any one may be exchanged with any other and still provide a fully functional invention. Moreover, as one example, a magnetic connection between the support surface 32 and smoke detector 30 such as described in connection with the FIGS. 1–5 embodiments could be used with the snap connection between the pole 34 and smoke detector 30 as described in connection with the FIGS. 12–14 embodiment, where the relative relationship of X, Y and Z is maintained. As yet another of many such examples, a magnetic connection could alternatively be provided between the pole 34 and the smoke detector 30, with a snap connection provided between the support surface 32 and the smoke detector. At this stage in development, it appears that the snap-type embodiment is the best mode for coupling the topside of the smoke detector 30 to the support surface 32, and a magnet mounted on the lower side of the detector 30 that can couple to a magnet on the pole 34 would be the best-mode for the lower coupling.

It should also be appreciated that the use of conical connecting components may be advantageously used in connection with the present application to assist in properly positioning components being secured together. For example, it can be seen in FIGS. 6–7, portions of upper nut plate 106 taper inward to facilitate entry into the annular opening of the support screw plate 100, portions of the lower screw plate 110 and lower nut plate 114 taper to facilitate entry into each other (see FIGS. 6–9), and detector snap plate 202 tapers inward to facilitate entry into support snap plate 202 (see FIGS. 12–13). Particularly for the magnetic connections, this type geometry creates a go-no go situation where there is either a "full" magnetic coupling or there is no coupling.

It should thus be appreciated that, in use, smoke alarms and mounting kits embodying the present invention can be easily utilized to effect removable coupling of a smoke detector 30 from a distance relative to a support surface 32 within a building structure or the like. The present invention allows an individual to install and selectively decouple the smoke detector 30 from a distance from the support surface 32 so as to effect servicing of the smoke detector 30 and/or silencing of the smoke detector 30 due to a false alarm such as can be caused by cigarette smoke or smoke generated from cooking appliances within the home. Additionally, the present invention will enable the physically disabled and/or elderly to remove and install their smoke detectors with relative ease, and reduce injuries/deaths from the increased use of smoke detectors due to ease of use/install, reduced number of smoke detectors with missing or discharged batteries, and decreased number of falls from ladders.

Still other aspects, objects, and advantages of the present invention can be obtained from a study of the specification, the drawings, and the appended claims. It should be understood, however, that the present invention could be used in alternate forms where less than all of the objects and advantages of the present invention and preferred embodiment as described above would be obtained.

What is claimed is:

1. A smoke detecting apparatus releasably securable to a support surface from a distance, comprising:

a smoke detector;

a support plate securable to the support surface;

a longitudinal member having a proximate end graspable by a user and a distal end releasably securable to said smoke detector;

a first releasable connection requiring a force of R on said smoke detector to connect said support plate and said smoke detector;

a second releasable connection between said smoke detector and said longitudinal member distal end;

wherein both said first and second releasable connections are releasable by manipulation of said longitudinal member by a user grasping said longitudinal member proximate end; and wherein said first releasable connection and said second releasable connection are threaded engagements and said second releasable connection is releasable by a force of S, where R and S are torques and S>R.

2. The apparatus of claim 1, wherein said second releasable connection includes a snap releasable with a relative torque of S between said smoke detector and said longitudinal member distal end.

3. The apparatus of claim 1, wherein said first releasable connection and said second releasable connection comprise matching threaded connections whereby a torque applied to said longitudinal member by a user unscrews one of said first releasable connection and said second releasable connection and screws together the other of said first releasable connection and said second releasable connection.

4. The apparatus of claim 3, further comprising a snap connection between said smoke detector and said longitudinal member distal end, said snap connection requiring a torque of S to disconnect, wherein a torque of R screws together said first releasable connection until said smoke detector threaded connection is seated in said support plate threaded connection.

5. A smoke detecting apparatus releasably securable to a support surface from a distance, comprising:

a smoke detector;

a support plate securable to the support surface;

a longitudinal member having a proximate end graspable by a user and a distal end releasably securable to said smoke detector;

a first releasable snap connection between said support plate and said smoke detector;

a second releasable snap connection between said smoke detector and said longitudinal member distal end;

wherein both said first and second releasable connections are releasable by manipulation of said longitudinal member by a user grasping said longitudinal member proximate end; and wherein said second releasable connection comprises first and second selectable connectors on said longitudinal member distal end, said first and second selectable connectors being releasably connectable to said smoke detector.

6. The apparatus of claim 5, wherein:

said smoke detector weighs W;

said first connection has a separating force of Y;

said first selectable connector is secured to said smoke detector by a separating force no greater than X;

said second selectable connector is secured to said smoke detector by a separating force no less than Z;

at least one of X<(Y−W) and X<Y is true; and at least one of Y<Z and (Y−W)<Z is true.

7. The apparatus of claim 6, wherein X<(Y−W)<Z when said support surface is a ceiling, and X<Y<Z when said support surface is a wall.

8. The apparatus of claim 5, wherein said first and second selectable connectors comprise slotted balls receivable in a socket in said smoke detector, said first connector slotted ball having wider slots than said second connector slotted ball.

9. The apparatus of claim 8, wherein said longitudinal member has an axis, and said selected one of said first and second connectors, said smoke detector socket, and said detector plate are aligned along said axis.

10. A smoke detecting apparatus releasably securable to a support surface from a distance, comprising:

a smoke detector;

a support plate securable to the support surface;

a longitudinal member having a proximate end graspable by a user and a distal end releasably securable to said smoke detector;

a first releasable connection between said support plate and said smoke detector;

a second releasable connection between said smoke detector and said longitudinal member distal end;

wherein;

said support plate includes a first magnet releasably securable by a magnetic force greater than the smoke detector weight W to said smoke detector;

both said first and second releasable connections are releasable by manipulation of said longitudinal member by a user grasping said longitudinal member proximate end;

said first releasable connection has a separating force of Y;

said longitudinal member distal end includes a second magnet magnetically attracted to said smoke detector, and further comprising a selectable spacing member adapted to space said second magnet from said smoke detector by a distance A, wherein said magnetic attraction between said second magnet and said smoke detector is Z when adjacent and X when spaced apart a distance A;

at least one of X<(Y−W) and X<Y is true; and at least one of Y<Z and (Y−W)<Z is true.

11. The apparatus of claim 10, wherein said first releasable connection connects said support plate and said smoke detector at one of different relative angular orientations about a center and further comprising:

at least one first electrical contact on one of said support plate and smoke detector;

at least one second electrical contact on the other of said support plate and smoke detector;

wherein said first electrical contact is annular with a selected radius about said center and said second electrical contact is spaced said selected radius from said center whereby said first and second electrical contacts are in contact in all of said different relative angular orientations.

12. A smoke detecting apparatus releasably securable to a support surface from a distance, comprising:

a smoke detector including a detector plate, said smoke detector weighing W;

a support plate securable to the support surface and releasably securable to said detector plate, said support plate and detector plate released from one another with a separating force of Y;

a longitudinal member having a proximate end graspable by a user and a distal end releasably securable to said smoke detector, said distal end including a selectable first connector releasably securable to said smoke detector for mounting said smoke detector to said support plate and a selectable second connector securable to said smoke detector for detaching said smoke detector from said support plate, whereby said first connector is secured to said smoke detector by a separating force no greater than X and said second connector is secured to said smoke detector by a separating force no less than Z, where Y>W, at least one of X<(Y−W) and X<Y is true; and at least one of Y<Z and (Y−W)<Z is true.

13. The apparatus of claim 12, wherein said releasable securing of said support plate and said detector plate comprises a releasable snap connector.

14. The apparatus of claim 13, wherein said first and second connectors comprise snap connectors.

15. The apparatus of claim 14, wherein said first and second connectors comprise slotted balls receivable in a socket in said smoke detector, said first connector slotted ball having wider slots than said second connector slotted ball.

16. The apparatus of claim 15, wherein said longitudinal member has an axis, and said selected one of said first and second connectors, said smoke detector socket, and said detector plate are aligned along said axis.

17. The apparatus of claim 12, wherein said support plate includes a first magnet releasably securable to said detector plate, wherein said detector plate and first magnet are securable together by a magnetic attraction force greater than W.

18. The apparatus of claim 17, wherein said detector plate is magnet, said first magnetic and said detector plate being circular.

19. The apparatus of claim 12, wherein said support plate is releasably securable to said smoke detector at one of different relative angular orientations about a center and further comprising:

at least one first electrical contact on one of said support plate and smoke detector;

at least one second electrical contact on the other of said support plate and smoke detector;

wherein said first electrical contact is annular with a selected radius about said center and said second electrical contact is spaced said selected radius from said center whereby said first and second electrical contacts are in contact in all of said different relative angular orientations.

20. The apparatus of claim 12, wherein said longitudinal member distal end includes a second magnet magnetically attracted to said smoke detector, and further comprising a selectable spacing member adapted to space said second magnet from said smoke detector by a distance A, wherein said magnetic attraction between said second magnet and said smoke detector is Z when adjacent and X when spaced apart a distance A.

21. The apparatus of claim 12, wherein the support plate has a concave conical mating surface.

22. The apparatus of claim 21, wherein the detector plate has a convex conical mating surface.

23. The apparatus of claim 12, wherein one of said support plate and said detector plate includes a first magnet releasably securable to the other of said support plate and said detector plate, wherein first magnet and said other of said support plate and said detector plate are securable together by a magnetic attraction force greater than W.

24. The apparatus of claim 12, wherein one of said smoke detector and said longitudinal member distal end includes a second magnet magnetically attracted to the other of said smoke detector and said longitudinal member distal end, and further comprising a selectable spacing member adapted to space said second magnet from said other of said smoke detector and said longitudinal member distal end by a distance A, wherein said magnetic attraction between said second magnet and said other of said smoke detector and said longitudinal member distal end is Z when adjacent and X when spaced apart a distance A.

25. A kit for releasably securing a smoke detector to a support surface from a distance, comprising:

a support plate securable to the support surface;

a longitudinal member having a proximate end graspable by a user and a distal end releasably securable to said smoke detector;

a first releasable connecting member adapted to connect the support plate and the smoke detector, said first connecting member securing a connected support plate and smoke detector against disconnecting when subjected to a separating force up to Y;

a second releasable connecting member adapted to connect the smoke detector and the longitudinal member distal end, said second releasable connecting member including selectable first and second connectors, wherein said first connector is secured to said smoke detector by a separating force no greater than X, said second connector is secured to said smoke detector by a separating force no less than Z, at least one of X<(Y−W) and X<Y is true, where W is the weight of the smoke detector, and at least one of Y<Z and (Y−W)<Z is true.

26. The kit of claim 25, wherein said second releasable connection comprises first and second selectable connectors on said longitudinal member distal end, said first and second selectable connectors releasably connectable to said smoke detector.

27. The kit of claim 26, wherein said first releasable connection and said second releasable connection comprise snap connectors.

28. The kit of claim 27, wherein said first and second connectors comprise slotted balls receivable in a socket in said smoke detector, said first connector slotted ball having wider slots than said second connector slotted ball.

29. The kit of claim 25, wherein:

said smoke detector weighs W;

said first releasable connection has a separating force of Y;

said second releasable connection includes a magnet on said longitudinal member distal end, said magnet being magnetically attracted to said smoke detector, and a selectable spacing member adapted to space said magnet from said smoke detector by a distance A, wherein said magnetic attraction between said second magnet and said smoke detector is Z when adjacent and X when spaced apart a distance A, where $X<(Y-W)<Z$.

30. The kit of claim 25, wherein:

said smoke detector weighs W;

said first releasable connection has a separating force of Y;

said second releasable connection includes a magnet on one of said smoke detector and said longitudinal member distal end, said magnet being magnetically attracted to the other of said smoke detector and said longitudinal member distal end, and a selectable spacing member adapted to space said magnet from said smoke detector by a distance A, wherein said magnetic attraction between said second magnet and said other of said smoke detector and said longitudinal member distal end is Z when adjacent and X when spaced apart a distance A, where $X<(Y-W)<Z$.

31. A kit for releasably securing a smoke detector to a support surface from a distance, comprising:

a support plate securable to the support surface;

a longitudinal member having a proximate end graspable by a user and a distal end releasably securable to said smoke detector;

a first releasable connection requiring a force of R on said smoke detector to connect said support plate and said smoke detector;

a second releasable connection between said smoke detector and said longitudinal member distal end, wherein said first releasable connection and said second releasable connection are threaded engagements and said second releasable connection is releasable by a force of S, where R and S are torques and $S>R$.

32. The kit of claim 31, wherein said second releasable connection includes a snap releasable with a relative torque of S between said smoke detector and said longitudinal member distal end.

33. The apparatus of claim 31, wherein said first releasable connection and said second releasable connection comprise matching threaded connections whereby a torque applied to said longitudinal member by a user unscrews one of said first releasable connection and said second releasable connection and screws together the other of said first releasable connection and said second releasable connection.

34. The apparatus of claim 33, further comprising a snap connection between said smoke detector and said longitudinal member distal end, said snap connection requiring a torque of S to disconnect, wherein a torque of R screws together said first releasable connection until said smoke detector threaded connection is seated in said support plate threaded connection.

* * * * *